US009341979B1

(12) United States Patent
Tamarez Gomez et al.

(10) Patent No.: US 9,341,979 B1
(45) Date of Patent: May 17, 2016

(54) CLOSED LOOP FOCUSING SYSTEM

(71) Applicant: Xerox Corporation, Norwalk, CT (US)

(72) Inventors: Frank B. Tamarez Gomez, Rochester, NY (US); Paul A. Hosier, Rochester, NY (US); Timothy P. Foley, Marion, NY (US); Douglas A. Gutberlet, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/594,567

(22) Filed: Jan. 12, 2015

(51) Int. Cl.
*G03G 15/04* (2006.01)
*G03G 15/043* (2006.01)

(52) U.S. Cl.
CPC ..... *G03G 15/0435* (2013.01)

(58) Field of Classification Search
CPC ..... G03G 15/04054; B41J 2/45
See application file for complete search history.

(56) References Cited

U.S. PATENT DOCUMENTS 6,603,580 B1 * 8/2003 Taillie ..... H04N 1/047 355/25
2004/0118921 A1 6/2004 Breytman et al.
2004/0228652 A1 * 11/2004 Fujiwara ..... G03G 15/04054 399/117
2008/0068439 A1 * 3/2008 Koshimura ..... B41J 2/451 347/238
2008/0285992 A1 * 11/2008 Joichi ..... B41J 2/45 399/51
2011/0050836 A1 * 3/2011 Masuda ..... B41J 2/451 347/224
2011/0096133 A1 * 4/2011 Nagamine ..... B41J 2/45 347/224

* cited by examiner

*Primary Examiner* — G.M. Hyder
(74) *Attorney, Agent, or Firm* — Simpson & Simpson, PLLC

(57) ABSTRACT

A system for focusing light including a gradient index lens array positioned at a first distance from a surface, and first and second positioning elements arranged to modify the first distance. The first and second positioning elements modify the first distance based on an analysis of an image formed on the surface across substantially a full width of a cross process direction of the surface.

23 Claims, 11 Drawing Sheets

CLOSED LOOP FOCUSING SYSTEM

TECHNICAL FIELD

The presently disclosed embodiments are directed to providing a focusing system, more particularly to a closed loop focusing system, and even more particularly to a closed loop focusing system used with a gradient index lens array. In some instances, the present embodiments may also be used with an array of light emitting structures and/or an array of light detecting structures.

BACKGROUND

As the yield and efficiency of light emitting diode (LED) technology has improved, LED print bar (LPB) imagers have been developed and used for xerographic printing applications, in higher performance and higher quality applications. For yield reasons, optical performance and compactness, full width LPBs, i.e., LPBs spanning the entire cross process direction, are often made as multi-chip assemblies carefully assembled and focused in a housing with a SELFOC® lens array, i.e., a gradient index lens array or GRIN lens array, as shown in FIG. 1. For clarity, the housing has been omitted in FIG. 1. SELFOC® lens array 50 is arranged between multi-chip LED array assembly 52 and photoreceptor drum 54. It should be appreciated that although a photoreceptor drum is depicted in FIG. 1, other photosensitive surfaces may also be used in the foregoing arrangement, e.g., a photoreceptor belt. During xerographic printing, LED light 56 from array assembly 52 is focused on drum 54 via lens array 50. The "self-focusing" property of SELFOC® lenses is well known in the art and therefore not further described herein.

As shown in FIG. 2, SELFOC® lens array 50 may be formed from a plurality of gradient index lens 58 within housing 60. Housing 60 may include angled wall 62 which causes lenses 58 to align in two rows, wherein the second row is offset from the first row. In an embodiment, the longitudinal axis of each lens 58 in the second row is the aligned with the point of contact between two adjacent lenses 58 in the first row.

Due to the construction methods and characteristics of LEDs, LED chips and lenses, a LPB has imperfect imaging characteristics which can negatively impact print quality. For example, one source of imperfect imaging is the characteristics of the SELFOC® lenses with their limited depth of focus and collection of light through several individual lenslet rods in the SELFOC® array of lenses. Not only does the image become out of focus quickly along the axial direction of the array lenslets, the image also becomes blurred in unique ways due to separation of focal rays from the lenses contributing to the image at a given point. FIGS. 3-8 depict various out of focus conditions according to optical modeling which agree with actual lens performance.

Even though the power of individual LEDs may vary within a chip and between chips, the LPB output power can be corrected to an acceptable uniformity of illumination within a chip and between chips using internal stored non-volatile memory (NVM) correction values. This correction works well when the LPB is in focus and all spots have the same basic shape. However, the developed photoreceptor image as the spot focus changes may be problematic, see for example FIGS. 9-11, where cross process profiles are shown for a LED spot in focus and two types of defocus, respectively.

Depending on development threshold, halftone design, xerographic resolution, print quality required and several other factors, it may be necessary to hold the LED focus range to a very small value, e.g., +/−50 μm for typical LPBs. This requires precision tolerancing of mounting hardware, i.e., higher costs, or tedious manual set-up in manufacturing and possibly in field service replacement of LPBs or backer bar for the photoreceptor. Even with such measures, the optimum focus and print quality is not obtainable. The present disclosure addresses all these problems in a practical and cost effective method.

SUMMARY

Broadly, the apparatus and methods discussed infra provide a closed loop system used to focus light emanating from LED print bars in printers by adjusting positioning elements such as piezopositioner actuators in the mounting hardware of the print bar. In some embodiments, the adjustment is based on measured contrast from an image sensor quantification of line pairs (See. e.g., FIG. 17) or average density of sparse halftone targets. Various algorithms may be used to step the positioning element at each end of the LPB to positions that maximize contrast and thereby determine the best focus.

According to aspects illustrated herein, there is provided a system for focusing light including a gradient index lens array positioned at a first distance from a surface, and first and second positioning elements arranged to modify the first distance. The first and second positioning elements modify the first distance based on an analysis of an image formed on the surface across substantially a full width of a cross process direction of the surface.

According to other aspects illustrated herein, there is provided a method for focusing light in a system including a gradient index lens array positioned at a first distance from a surface and first and second positioning elements arranged to modify the first distance. The method includes: a) analyzing an image formed on the surface across substantially a full width of a cross process direction of the surface using an arithmetic logic unit; b) modifying the first distance using the first and second positioning elements based on the step of analyzing; and, c) repeating steps a) and b) until an acceptable analysis is obtained.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1:
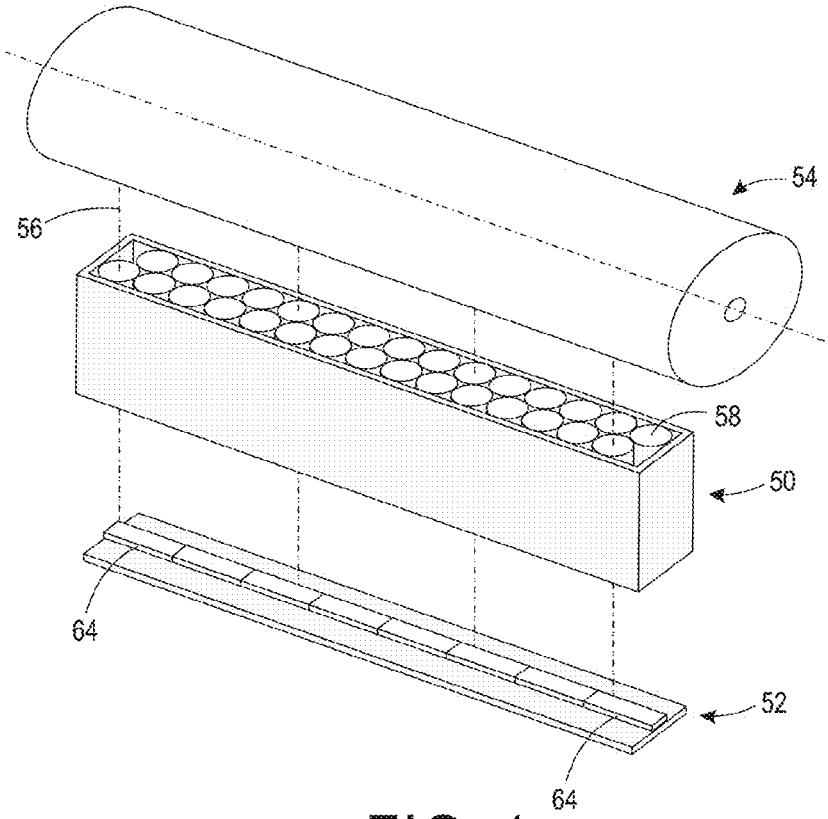
FIG. 1 is a perspective view of a portion of a known light emitting diode, gradient index lens array and photoreceptor arrangement
Figure 2:
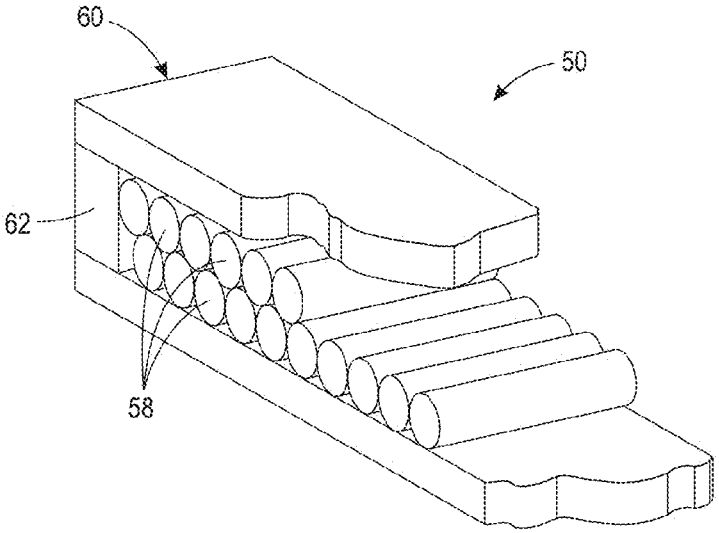
FIG. 2 is an partial perspective view of a known gradient index lens array having a portion of its housing removed.
Figure 3:
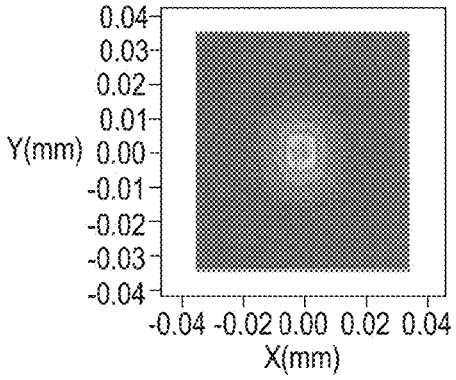
FIG. 3 is a graphical output from a model of the system of FIG. 1 arranged at best focus (−0.4 mm from paraxial focus) and showing the system's image output at the top row of lenses.
Figure 4:
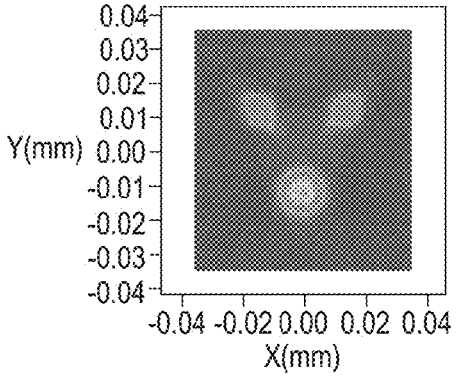
FIG. 4 is a graphical output from a model of the system of FIG. 1 arranged at −0.3 mm from paraxial focus and showing the system's image output at the top row of lenses.
Figure 5:
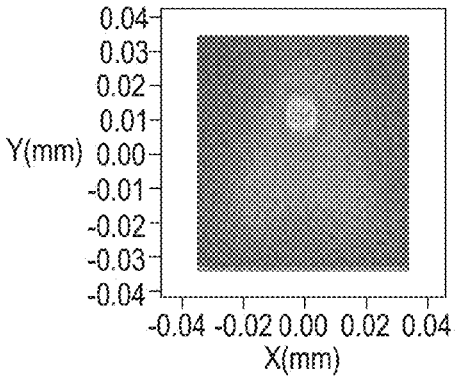
FIG. 5 is a graphical output from a model of the system of FIG. 1 arranged at −0.5 mm from paraxial focus and showing the system's image output at the top row of lenses.
Figure 6:
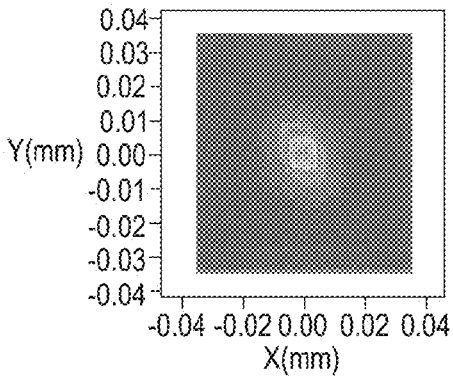
FIG. 6 is a graphical output from a model of the system of FIG. 1 arranged at best focus (−0.4 mm from paraxial focus) and showing the system's image output between rows of lenses.
Figure 7:
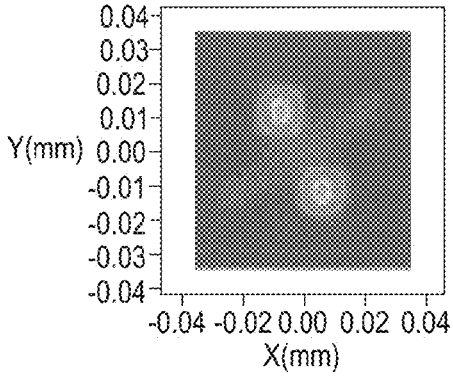
FIG. 7 is a graphical output from a model of the system of FIG. 1 arranged at −0.3 mm from paraxial focus and showing the system's image output between rows of lenses.
Figure 8:
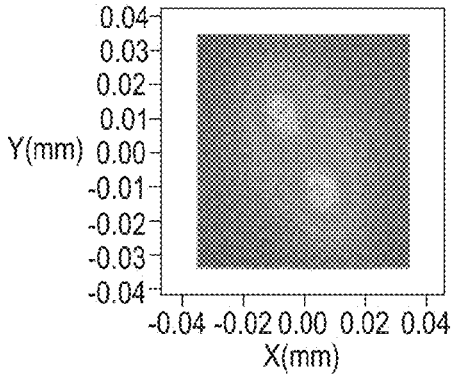
FIG. 8 is a graphical output from a model of the system of FIG. 1 arranged at −0.5 mm from paraxial focus and showing the system's image output between rows of lenses.
Figure 9:
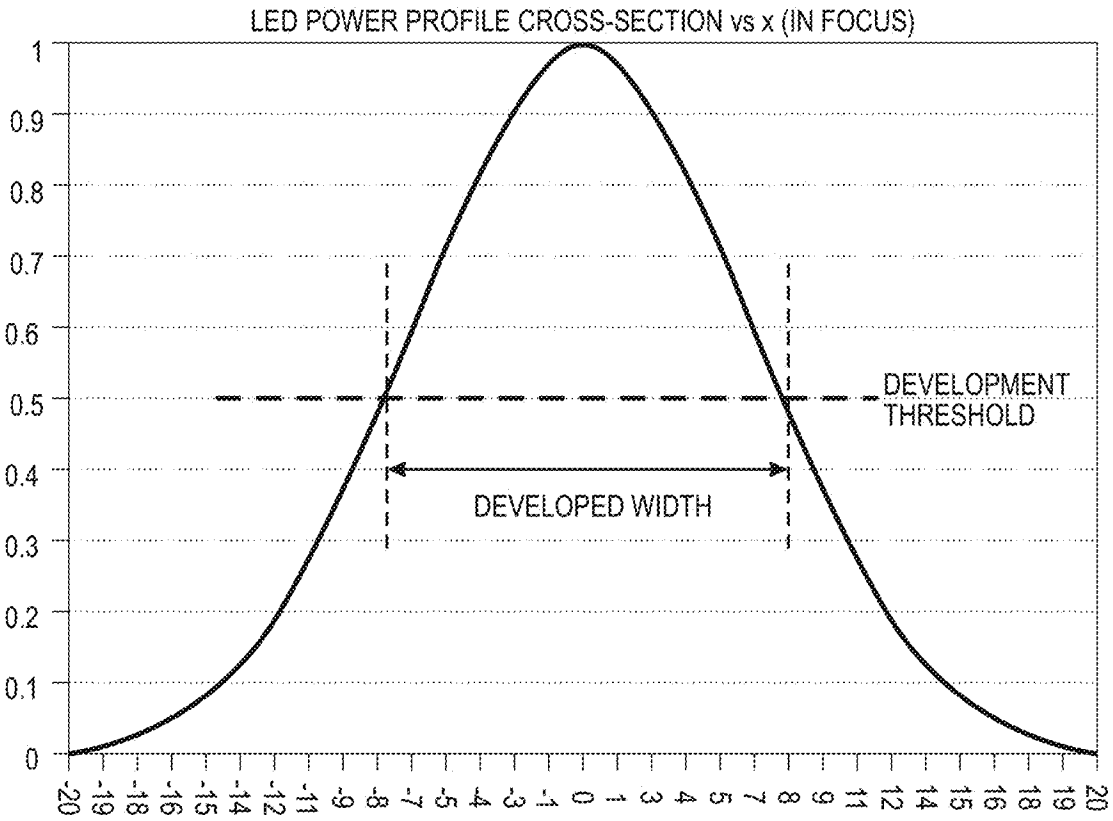
FIG. 9 is a graphical output from a model of an in focus light emitting diode power profile across its width.
Figure 10:
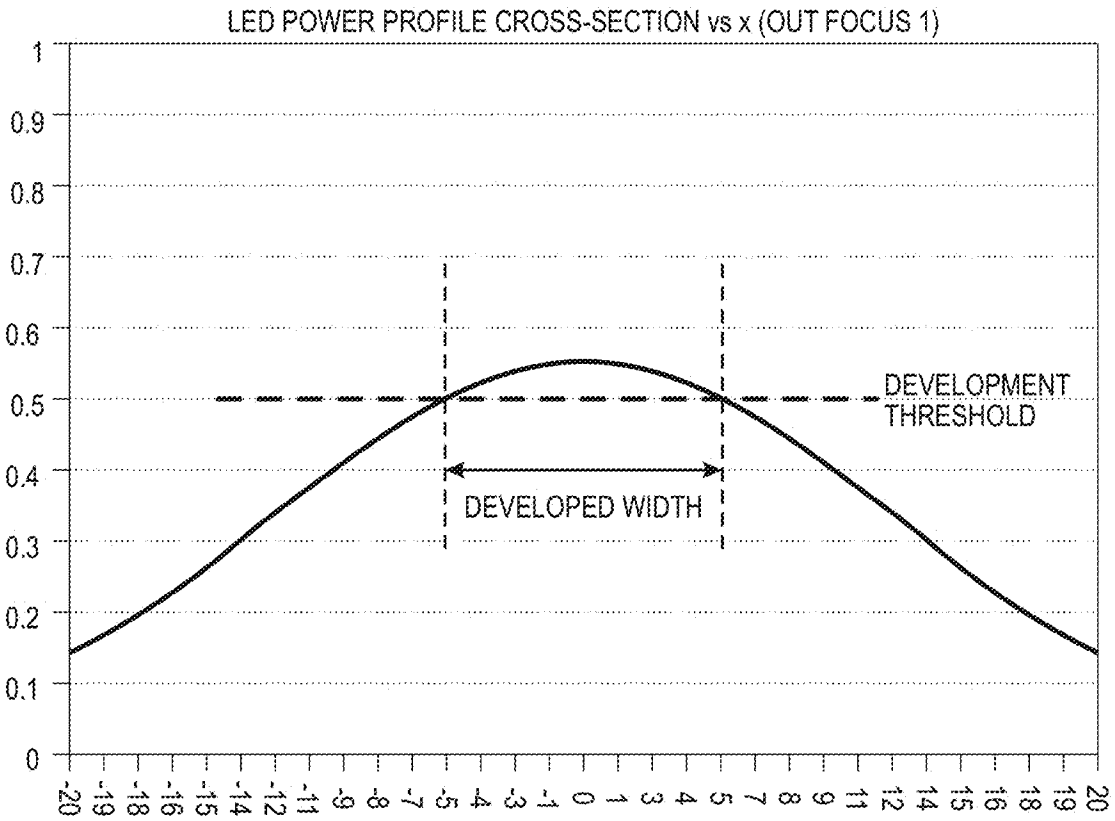
FIG. 10 is a graphical output from a model of a first out of focus light emitting diode power profile across its width.
Figure 11:
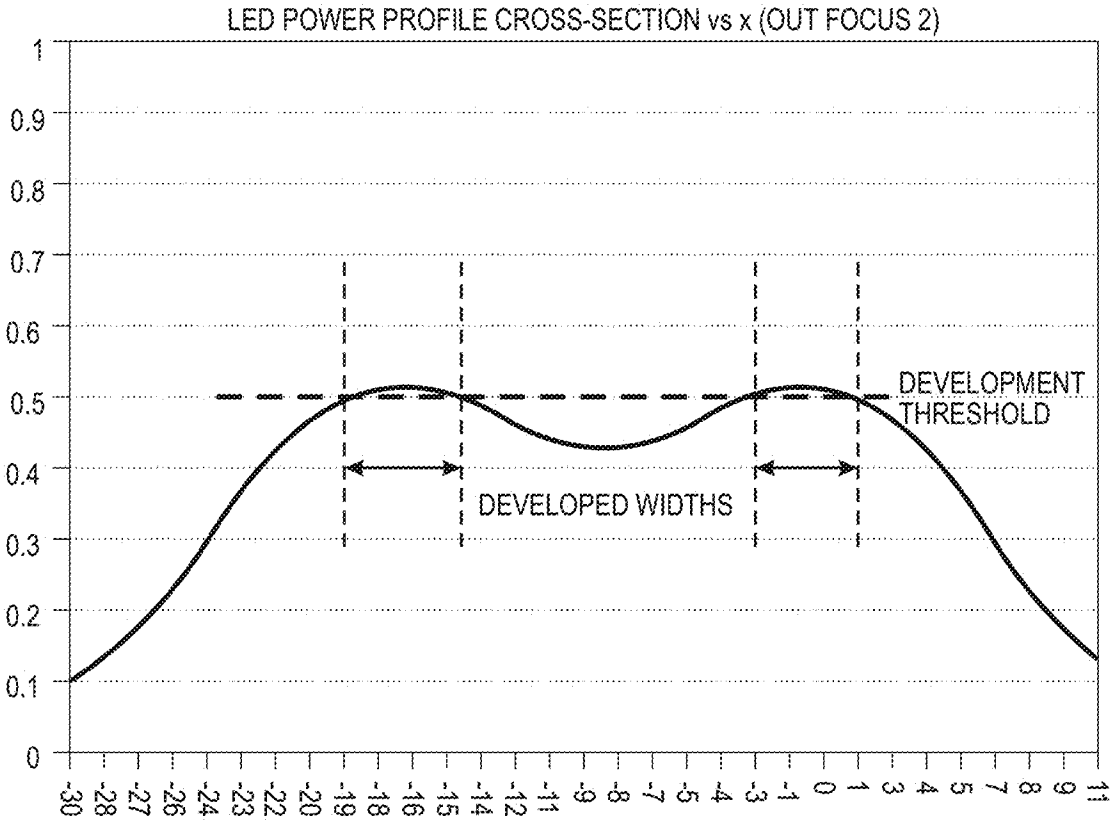
FIG. 11 is a graphical output from a model of a second out of focus light emitting diode power profile across its width.
Figure 12:
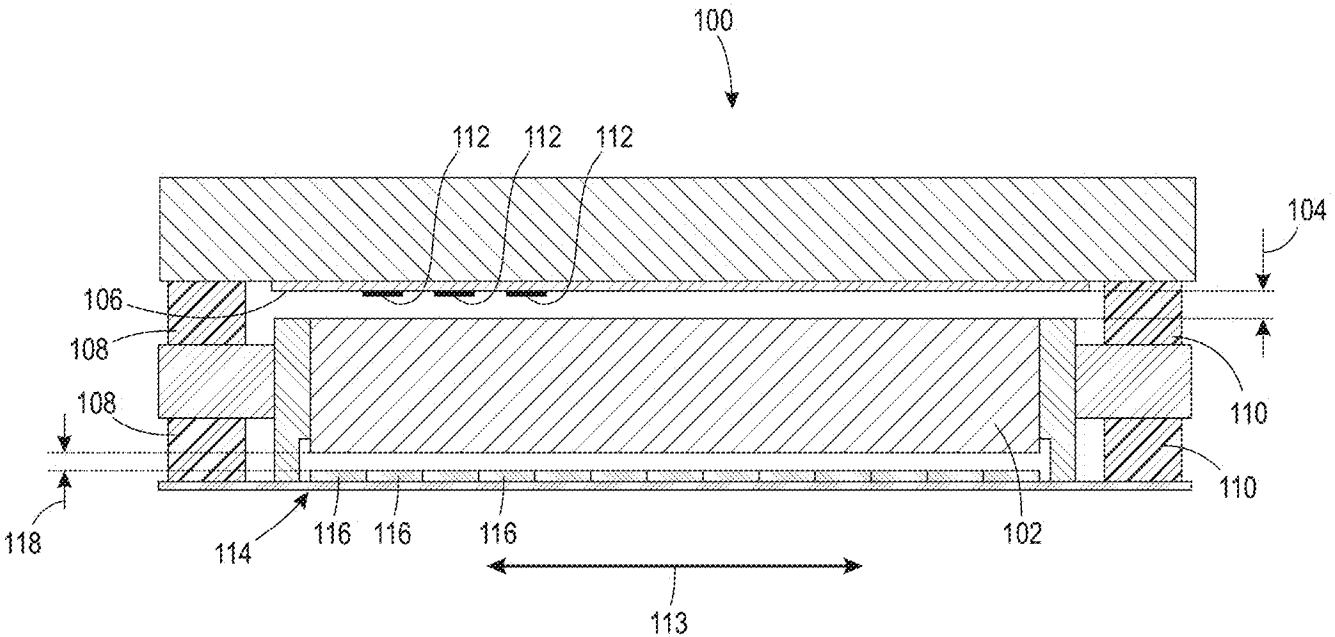
FIG. 12 is a cross sectional schematic view of an embodiment of the present system.
Figure 13:
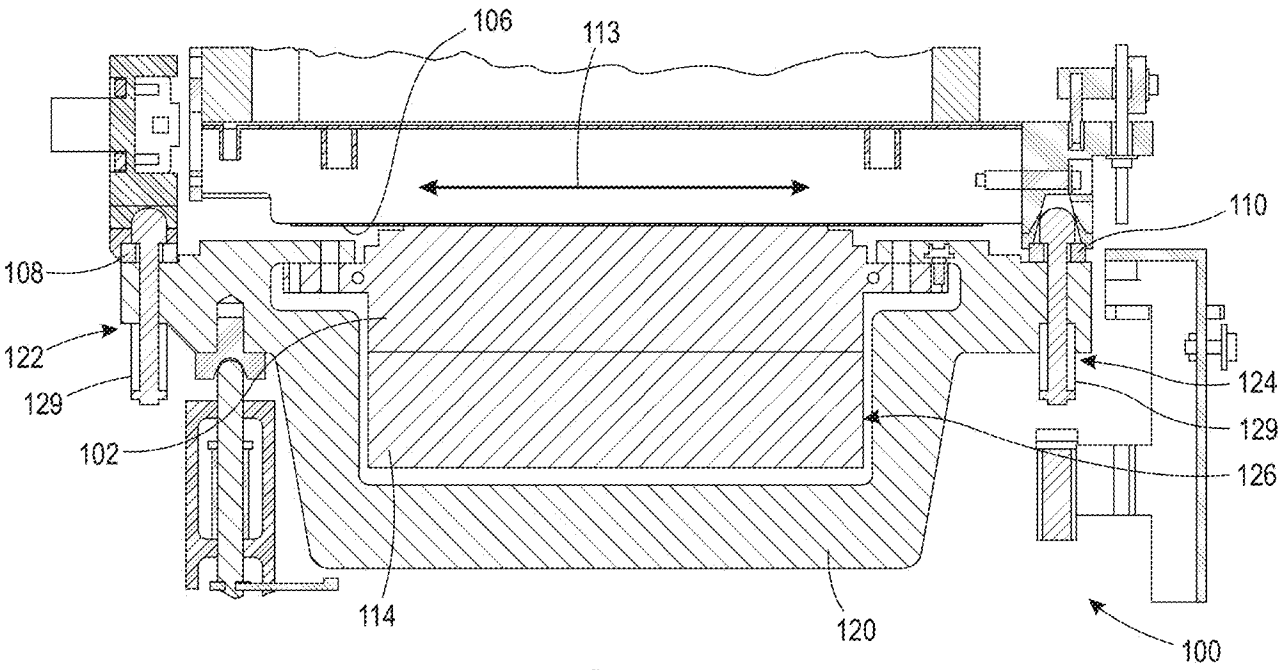
FIG. 13 is a top plan view of an embodiment of the present system arranged within a printing system.
Figure 14:
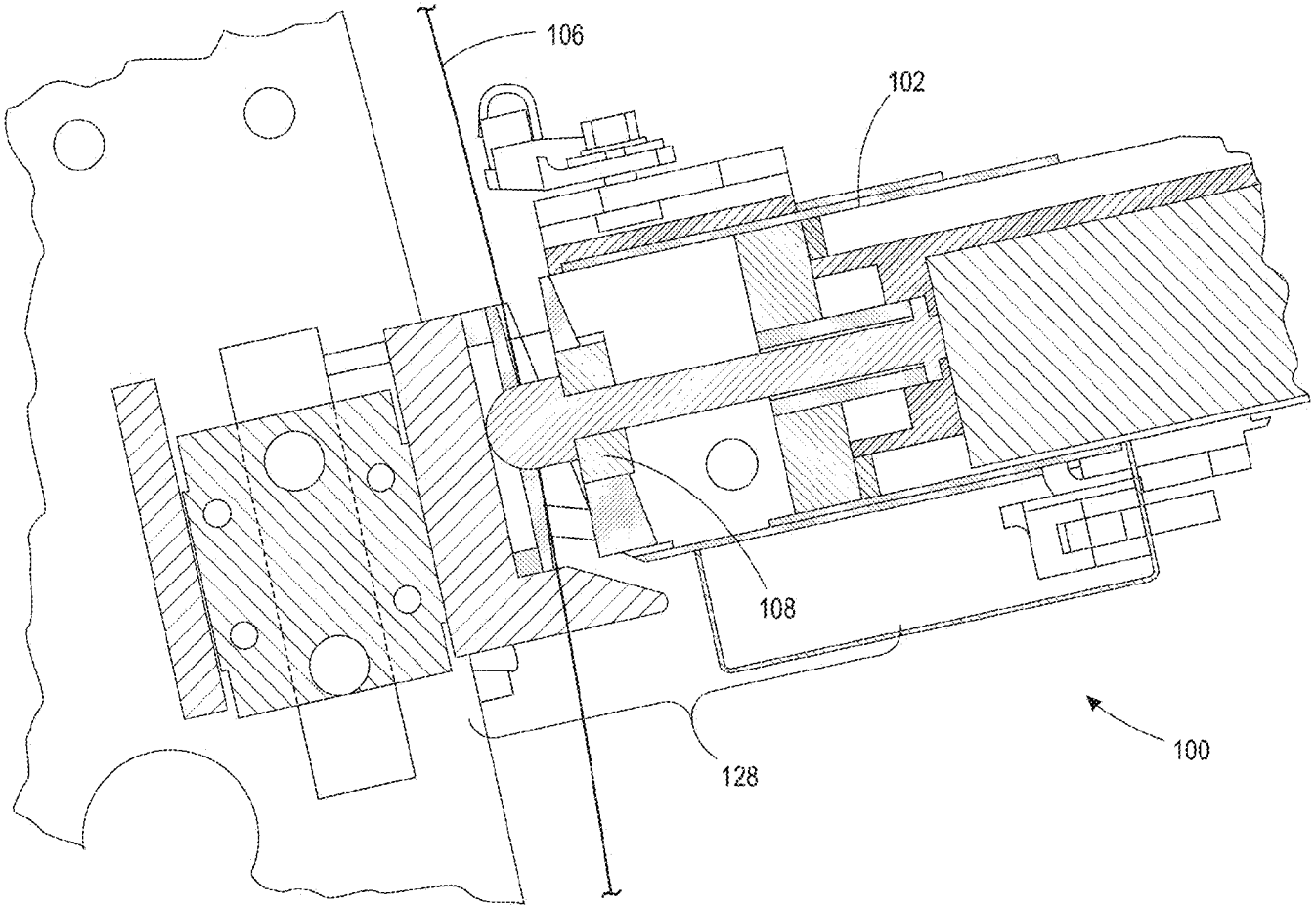
FIG. 14 is a side elevational view of an embodiment of the present system arranged within a printing system.
Figure 15:
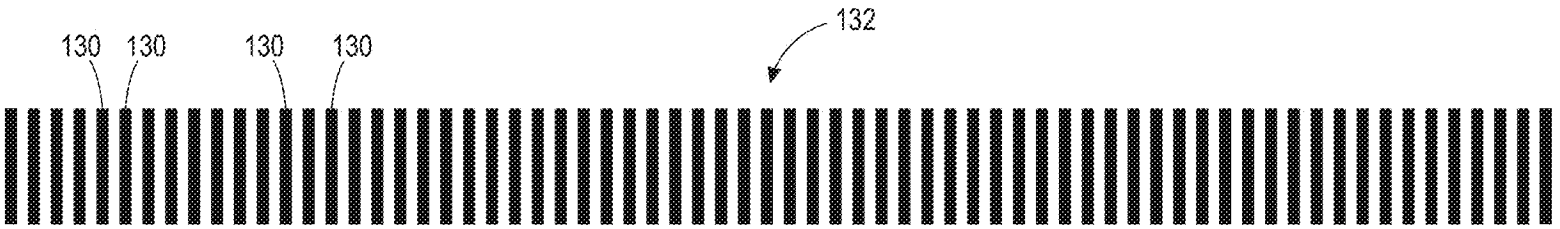
FIG. 15 is an embodiment of a test image comprising line pairs.
Figure 16:
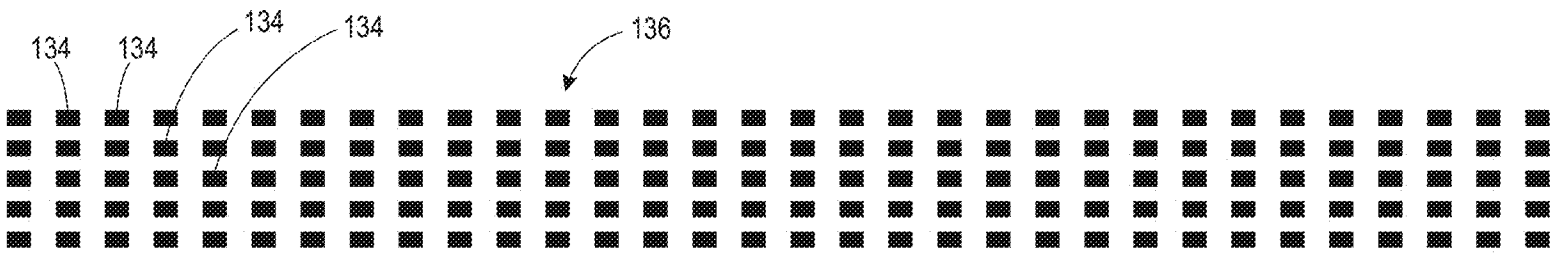
FIG. 16 is an embodiment of a test image comprising halftones.

At the outset, it should be appreciated that like drawing numbers on different drawing views identify identical, or functionally similar, structural elements of the embodiments set forth herein. Furthermore, it is understood that these embodiments are not limited to the particular methodology, materials and modifications described and as such may, of course, vary. It is also understood that the terminology used herein is for the purpose of describing particular aspects only, and is not intended to limit the scope of the disclosed embodiments, which are limited only by the appended claims.

Unless defined otherwise, all technical and scientific terms used herein have the same meaning as commonly understood to one of ordinary skill in the art to which these embodiments belong. As used herein, "average" is intended to be broadly construed to include any calculation in which a result datum or decision is obtained based on a plurality of input data, which can include but is not limited to, weighted averages, yes or no decisions based on rolling inputs, etc. Furthermore, as used herein, "average" and/or "averaging" should be construed broadly to include any algorithm or statistical process having as inputs a plurality of signal outputs, for any purpose. A "device useful for digital printing" or "digital printing" broadly encompasses creating a printed output using a processor, software and digital-based image files. It should be further understood that xerography, for example using light emitting diodes (LEDs), is a form of digital printing. "Light emitting diodes" and/or "LEDs" is intended to include the LEDs without additional components, as well as mirrors used to reflect light from LEDs so that the mirrors act as emitters within an optical system. In other words, "LEDs" should be broadly construed to include all emitting structures whether that structure is the original source of illumination or a light reflecting surface positioned within the optical path after the original source. Moreover, as used herein, "full width array" is intended to mean an array or plurality of arrays of photosensors having a length equal or greater than the width of the substrate to be coated, for example, similar to the full width array taught in U.S. Pat. No. 5,148,268. Substantially full width is defined and described infra when used in the context of some embodiments of the present system and method.

As used herein, "image bearing surface" is intended to mean any surface or material capable of receiving an image or a portion of an image, e.g., a photoreceptor drum, a photoreceptor belt, an intermediate transfer belt, an intermediate transfer drum, an imaging drum, or a document. As used herein, "image" and "printed image" is intended to be broadly construed as any picture, text, character, indicia, pattern or any other printed matter. Printed images can include but are not limited to logos, emblems and symbols. Moreover, "image" includes an electrostatic latent image, as is familiar in xerography, and an "electrostatic latent image" is an image borne by a photoreceptor surface, i.e., the latent image begins as an arrangement of charged and discharged areas on a photoreceptor surface and no image becomes visible until the photoreceptor is developed with toner which is attracted to the charged areas in the electrostatic latent image. It is believed that electrostatic latent images may be detected by an electrostatic voltmeter, i.e., a voltmeter capable of detecting and quantifying charged and uncharged areas on a surface. It is further believed that an electrostatic voltmeter could be arranged as a high resolution sensor, a full width array sensor, a focus detection sensor or a combination of the foregoing sensors. As used herein, "process direction" is intended to mean the direction of media transport through a printer or copier, while "cross process direction" is intended to mean the perpendicular to the direction of media transport through a printer or copier. With respect to the term "real time", for human interactions we mean that the time span between a triggering event and an activity in response to that event is minimized, while in a computer context we mean that data manipulation and/or compensation which occurs with little or no use of a processor, thereby resulting in efficient data manipulation and/or compensation without added processor overhead, such as delaying raw data transmission without any computational analysis of the same.

Furthermore, the words "printer," "printer system", "printing system", "printer device" and "printing device" as used herein encompasses any apparatus, such as a digital copier, bookmaking machine, facsimile machine, multi-function machine, etc. which performs a print outputting function for any purpose, while "multi-function device" and "MFD" as used herein is intended to mean a device which includes a plurality of different imaging devices, including but not limited to, a printer, a copier, a fax machine and/or a scanner, and may further provide a connection to a local area network, a wide area network, an Ethernet based network or the internet, either via a wired connection or a wireless connection. An MFD can further refer to any hardware that combines several functions in one unit. For example, MFDs may include but are not limited to a standalone printer, one or more personal computers, a standalone scanner, a mobile phone, an MP3 player, audio electronics, video electronics, GPS systems, televisions, recording and/or reproducing media or any other type of consumer or non-consumer analog and/or digital electronics. Additionally, as used herein, "sheet," "sheet of paper" and "paper" refer to, for example, paper, transparencies, parchment, film, fabric, plastic, photo-finishing papers or other coated or non-coated substrate media in the form of a web upon which information or markings can be visualized and/or reproduced.

Moreover, although any methods, devices or materials similar or equivalent to those described herein can be used in the practice or testing of these embodiments, some embodiments of methods, devices, and materials are now described.

The present disclosure describes a system and method for focusing light. Broadly, the present system, i.e., system 100, includes gradient index lens array 102 positioned a distance 104 from surface 106, e.g., a photoreceptor belt. System 100 further includes positioning elements 108 and 110 arranged to modify distance 104. Positioning elements 108 and 110 modify distance 104 based on an analysis of an image formed on surface 106, e.g., image 112. The analysis is performed across a full width or approximately the full width of cross process direction 113 of surface 106. Surface 106 may be any surface capable receiving an image. For example, surface 106 may be a photoreceptor belt or a photoreceptor drum. Similarly, surface 106 may be a sheet, a web, or any other media type capable of receiving an image. Moreover, distance 104 may be unique at each positioning element 108 and 110, i.e., distance 104 may vary in cross process direction 113. The foregoing is explained in greater detail infra.

In some embodiments, system 100 further includes array 114 of light emitting diodes (LEDs) 116 positioned at distance 118 from gradient index lens array 102. Array 102 forms image 112 on surface 106, which image 112 originates from array 114. Positioning elements 108 and 110 may be arranged to modify distance 104, distance 118, or distances 104 and 118. In some embodiments, array 114 is a linear array, e.g., a single line of LEDs, or a two dimensional array, e.g., multiple adjacent lines of LEDs. Similar to distance 104, as described above, distance 118 may vary in cross process direction 113.

In some embodiments, system 100 includes an array of photodiodes positioned at a distance from a gradient index lens array. As with array 114, the array of photodiodes is arranged across the full width or substantially the full width of the cross process direction and is arranged to quantify at least one measured characteristic of the image, e.g., regularity of a test pattern, parallelism between adjacent lines, etc. The analysis of the image includes a comparison of the at least one measured characteristic of the image to at least one known characteristic of the image. In short, system 100 may include or may be interacted with to introduce known characteristics of a test pattern, and those known characteristic are compared to measured characteristics to quantify the quality of focus in system 100, i.e., the image is analyzed. Based on that analysis, positioning elements 108 and 110 modify distance 104, distance 118 or distance 104 and 118. Again, as with array 114, the array of photodiodes may be a linear array or a two dimensional array. Although not expressly depicted in the figures, array 114 may be used to represent the array of photodiodes. However, in such embodiments, the array of photodiodes is arranged to receive light projecting or reflecting from surface 106, rather than the embodiments including array 114 where light projects or reflects from array 114.

Positioning elements 108 and 110 may be any means known to affect movement of one element relative to another. In some embodiments, positioning elements 108 and 110 are each a piezo actuator. Piezo actuators are arranged to accurately and controllably extend and retract in a linear direction, which linear movement can be used to modify distances between various elements, e.g., array 114 and gradient index lens array 102 or surface 106 and gradient index lens array 102. It should be appreciated that the present system may include positioning elements arranged to modify distance 104, arranged to modify distance 118, or arranged to modify both distances 104 and 118. In other words, the present system includes two positioning elements for embodiments where a single distance is modified and includes four positioning elements for embodiments where both distances are modified.

In addition to the foregoing present system, a present method for focusing light is also disclosed herein. As disclosed supra, system 100 includes gradient index lens array 102 positioned at distance 104 from surface 106 and positioning elements 108 and 110 arranged to modify distance 104. The present method includes analyzing an image, e.g., image 112, formed on a surface, e.g., surface 106, across a full width or substantially a full width of a cross process direction of the surface using an arithmetic logic unit, modifying the distance between the gradient index lens array and the surface using the positioning elements based on the step of analyzing, and repeating the foregoing steps until an acceptable analysis is obtained. It should be appreciated that "acceptable analysis" is intended to mean the present system has attained the best average focus across the full width or substantially the full width of the surface. As also described above, in some embodiments, the surface may be a photoreceptor belt or a photoreceptor drum, or any other surface capable of receiving an image, e.g., a sheet of media.

In some embodiments, the system further includes an array of light emitting diodes positioned at a distance from the gradient index lens array, and the array of light emitting diodes forms the image on the surface. In these embodiments, the method includes the step of modifying the distance between the gradient index lens array and the surface, the distance between the gradient index lens array and the array of light emitting diodes, or the distance between the gradient index lens array and the surface and the distance between the gradient index lens array and the array of light emitting diodes using the positioning elements based on the step of analyzing. As also described above, in some embodiments, the array of light emitting diodes may be a linear array or a two dimensional array.

In some embodiments, the system further includes an array of photodiodes positioned at a distance from the gradient index lens array, and the array of photodiodes is arranged across the full width or substantially the full width of the cross process direction and is arranged to quantify at least one measured characteristic of the image. In these embodiments, the method includes the steps of comparing the at least one measured characteristic of the image to at least one known characteristic of the image, and modifying the distance between the gradient index lens array and the surface, the distance between the gradient index lens array and the array of photodiodes, or the distance between the gradient index lens array and the surface and the distance between the gradient index lens array and the array of photodiodes using the positioning elements based on the results of the step of comparing. As also described above, in some embodiments, the array of photodiodes may be a linear array or a two dimensional array.

Moreover, as described above, in some embodiments, the positioning elements may each be a piezo actuator.

Generally, the present system is a closed loop system used to focus an image received from a source on a subsequent surface or element. In some embodiments, the source is an array of light emitting diodes arranged to produce a pattern of illumination and the subsequent surface or element is a photoreceptor belt or drum. In some embodiments, the source is a reflective surface, e.g., a mirror, arranged to receive light from an emitter and project the same toward the subsequent surface or element, e.g., a photoreceptor belt or drum. Thus, the reflective surface effectively forms a light-reflecting array, or in other words, the reflective surface acts as a source of illumination within the system. The foregoing embodiments are within the scope of the claimed present system and method.

Broadly, the present system for focusing light comprises two positioning elements, e.g., actuators, and a method for analyzing the light and effecting movement of the two positioning elements to focus light. Positioning elements 108 and 110, e.g., piezoelectric actuators, are inserted into mounting 120 at each mounting hardware location 122 and 124 of linear print bar 126. In some embodiments, positioning elements 108 and 110 afford a sufficient range of travel to cover focus actuation to adjust for the tolerance stack-up created by mounting hardware 128 and linear print bar 126. In some embodiments, positioning elements 108 and 110 provide actuation force sufficient to allow spring loaded docking, i.e., a spring force provided by springs 129 and mounting hardware 128. The present system accounts for various printing system needs, such as the ability to be retrofit in older printing systems. Thus, in some embodiments, the present system is sized to fit within the mounting structure of a variety of printing systems. In some embodiments, the present system includes an interface board that is incorporated within and driven/controlled by the communication aspects of the printing system.

In some embodiments, the present system comprises an image sensor to capture target images for analysis and quantification. The image sensor is capable of capturing an image along the entire length, i.e., full width, or substantially the entire length, i.e., substantially the full width, of the image in the cross process direction. It should be appreciated that as used herein the "entire length" or "full width" is intended to mean the entire length of the image, while "substantially the entire length" or "substantially the full width" is intended to mean greater than or equal to seventy-five percent (75%) of the entire length of the image. In some embodiments, higher resolution sensors provide improved analysis of the image and thereby improved focus, while in some embodiments, a lower resolution sensor is sufficient for system requirements. For example, a test image may comprise line pairs, e.g., line pairs 130 shown in test image 132, and a higher resolution sensor is preferred, or a test image may comprise sparse halftone, halftones 134 shown in test image 136, and a lower resolution sensor is preferred. It should be appreciated that the test pattern may be printed in an interdocument zone thereby permitting use of the present system and method during active printing operations.

Figure 17:
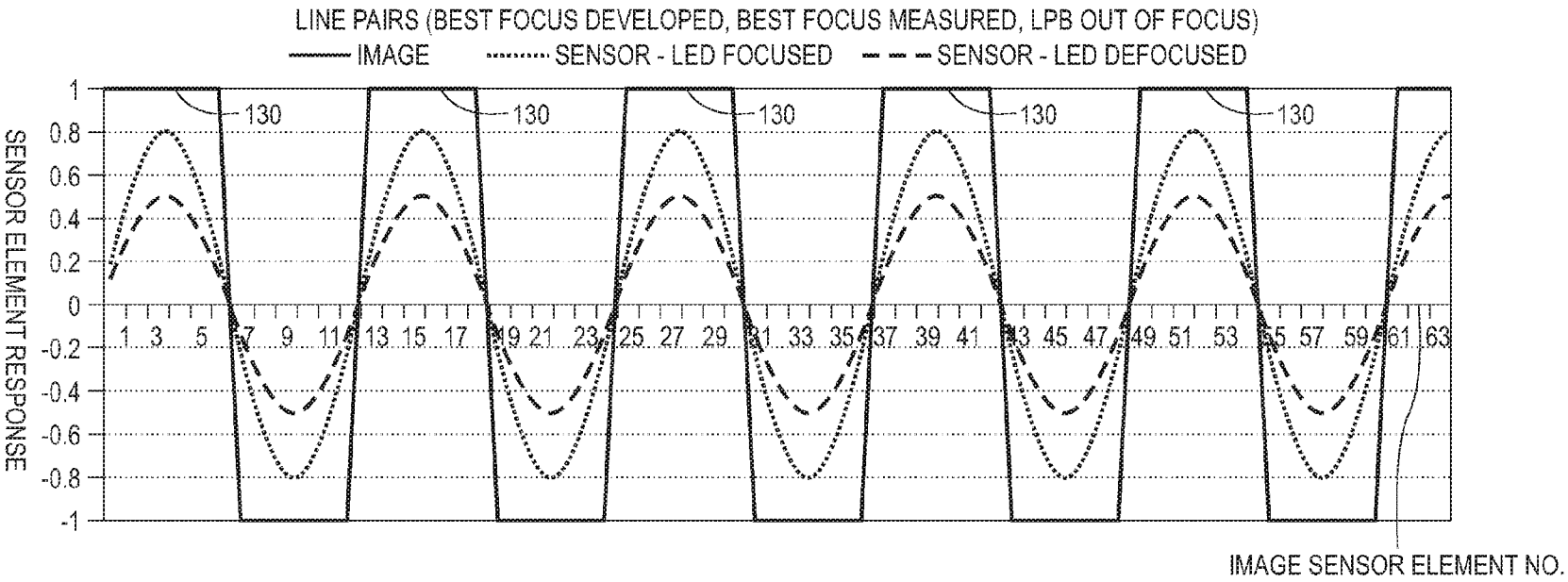
FIG. 17 is an example of an image analysis of a best focus condition and an out of focus condition shown with an ideal or theoretically perfect image focus.

Image data, i.e., data obtained from the image sensor (See. e.g., FIG. 17), is used to determine focus and subsequently a hunting algorithm is used to find best focus position, or in other words, the spacing between optical components is set to provide the best average focus across substantially the full length in the cross process direction. For example, in some embodiments, a simple peak-peak contrast calculation may be used along the cross process direction to obtain a measure of focus, while in some embodiments, more complex focus calculations may be used.

Because of the sensitivity of xerographic development to single spots, it is believed that sparse halftone will provide the best measure of focus while minimizing the calculation complexity. In some embodiments of the present image analysis and quantification includes measuring the average density of printing over several print lines and over several LEDs in the cross process direction. The average density of the foregoing measured area is maximized at the best focus.

In some embodiments of the present image analysis and quantification focus data and hunting algorithms are used to maximize contrast and thereby find the best average focus. One of the positioning elements, e.g., a piezoelectric actuator, is set to a nominal position at a first end of the linear print bar and focus is analyzed/quantified at that end. Next, that positioning element is moved by an increment, e.g., 10 μm or less, and focus is analyzed/quantified again. If the analyzed/quantified focus improves, the positioning element is again moved by another increment in the same direction. If the analyzed/quantified focus degrades, the positioning element is moved by an increment in the opposite direction. If the analyzed/quantified focus remains the same, movement of the positioning element stops and the same process is repeated at the second end of the linear print bar opposite the first end. After the best focus is obtained for each end of the linear print bar, the prior steps are repeated to minimize any interaction between the first and second ends of the linear print bar, and/or to optimize the focus across the full width or substantially the full width of the linear print bar, i.e., not just at the first and second ends. In view of the foregoing, it should be appreciated that the present system and method locates the best average focus across the full width or substantially the full width of the linear print bar thereby accommodating instances where the focus varies significantly in the middle of linear print bar. Various optimization methods may be used, such as maximizing the sum of the contrast from the middle 80% of the linear print bar or some other method most relevant to the linear print bar, the printer and/or printer applications.

The present system and method provide a linear print bar that may be focused during a setup routine automatically under system controls. Focusing is performed by positioning elements such as piezoelectric actuators located at each end of the linear print bar mounting. A full width or substantially full width image sensor quantifies test targets to determine focus quality while system controls hunt for the best average focus. It is believed that, in some embodiments, a target of sparse LED spots will be the most sensitive target to focus variations. The present system and method achieve the best image quality obtainable with a linear print bar. No manual setup is required during manufacturing or field service, and high price, high tolerance parts are eliminated.

The present disclosure proposes a closed loop system for optimizing the focus of LED print bars used in printers and copiers by adjusting positioning elements such as piezopositioner actuators in the mounting hardware of the print bar. The focus adjustment is based on measured contrast from an image sensor measurement of a target such as line pairs or average density of sparse halftone targets. An algorithm is used to step the positioning elements located at each end of the linear print bar to positions that maximize contrast and thereby find the best average focus for the length of the linear print bar. Due to the short focal length of the gradient index lens array used on linear print bars, it is necessary to tightly control the gap between the linear print bar and image bearing surface, e.g., a photoreceptor belt, as well as the parallelism of the linear print bar to the image bearing surface.

Although the foregoing disclosure describes use of the present apparatus and method in printing systems, use with other systems is also possible. For example, the above described apparatus and method may be used to determine the best focus of a lens or lens array used in a scanning operation. Thus, the positioning of a lens array between an image bearing surface and a detector array may be optimized in real-time while a scanning system is in use.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A system for focusing light comprising:

a gradient index lens array positioned at a first distance from a surface to form an image of an object onto the surface; and, first and second positioning elements, wherein the object being an array of light emitting diodes placed at a second distance from the gradient index lens array, the first distance being independent of the second distance, wherein the first and second positioning elements modify the first and/or second distance based on an analysis of the image formed on the surface across substantially a full width of a cross process direction of the surface.

2. The system of claim 1 wherein the surface is a photoreceptor belt or a photoreceptor drum.

3. The system of claim 1 wherein the array of light emitting diodes is a linear array or a two dimensional array.

4. The system of claim 1 wherein the first and second positioning elements are each a piezo actuator.

5. The system of claim 1 wherein the first and second positioning elements modify the first and/or second distance based on the analysis of the image formed on the surface across the full width of the cross process direction of the surface.

6. A system for focusing light comprising:

a gradient index lens array positioned at a first distance from a surface to project an image from the surface; and, an array of photodiodes positioned at a second distance from the gradient index lens array, the array of photodiodes arranged across the full width of the cross process direction and arranged to quantify at least one measured characteristic of the image, first and second positioning elements, wherein the first and second positioning elements modify the first distance and/or the second distance based on an analysis of the image received by the array of photodiodes across substantially a full width of a cross process direction.

7. The system of claim 6, wherein the analysis of the image comprises comparison of the at least one measured characteristic of the image to at least one known characteristic of the image, the first distance being independent of the second distance, and the first and second positioning elements modify the first distance, the second distance or the first and second distance based on the analysis of the image.

8. The system of claim 7 wherein the array of photodiodes is a linear array or a two dimensional array.

9. The system of claim 6 wherein the surface is a photoreceptor belt or a photoreceptor drum.

10. The system of claim 6 wherein the first and second positioning elements are each a piezo actuator.

11. The system of claim 6 wherein the first and second positioning elements modify the first and/or second distance based on the analysis of the image projected from the surface across the full width of the cross process direction of the surface.

12. A method for focusing light in a system comprising a gradient index lens array positioned at a first distance from a surface to form an image of an object onto the surface and first and second positioning elements arranged to modify the first distance, the method comprising:

a) analyzing the image formed on the surface across substantially a full width of a cross process direction of the surface using an arithmetic logic unit;

b) modifying the first distance using the first and second positioning elements based on the step of analyzing; and, c) repeating steps a) and b) until an acceptable analysis is obtained.

13. The method of claim 12 wherein the surface is a photoreceptor belt or a photoreceptor drum.

14. The method of claim 12 wherein the object being an array of light emitting diodes placed at a second distance from the gradient index lens array, the first distance being independent of the second distance and step b) comprises:

b) modifying the first distance, the second distance or the first and second distance using the first and second positioning elements based on the step of analyzing.

15. The method of claim 14 wherein the array of light emitting diodes is a linear array or a two dimensional array.

16. The method of claim 12 wherein the first and second positioning elements are each a piezo actuator.

17. The method of claim 12 wherein the step of analyzing comprises:

a) analyzing the image formed on the surface across the full width of the cross process direction of the surface using the arithmetic logic unit.

18. A method for focusing light in a system comprising a gradient index lens array positioned at a first distance from a surface to project an image from the surface and first and second positioning elements arranged to modify the first distance, the method comprising:

a) analyzing the image projected from the surface across substantially a full width of a cross process direction of the surface using an arithmetic logic unit;

b) modifying the first distance using the first and second positioning elements based on the step of analyzing; and, c) repeating steps a) and b) until an acceptable analysis is obtained.

19. The method of claim 18 wherein the system further comprises an array of photodiodes positioned at a second distance from the gradient index lens array, the array of photodiodes arranged across the full width of the cross process direction and arranged to quantify at least one measured characteristic of the image, the first distance being independent of the second distance and steps a) and b) comprise:

a) analyzing the image projected from the surface by comparing the at least one measured characteristic of the image to at least one known characteristic of the image; and, b) modifying the first distance, the second distance or the first and second distance using the first and second positioning elements based on the step of analyzing.

20. The method of claim 18 wherein the array of photodiodes is a linear array or a two dimensional array.

21. The method of claim 18 wherein the surface is a photoreceptor belt or a photoreceptor drum.

22. The method of claim 18 wherein the first and second positioning elements are each a piezo actuator.

23. The method of claim 18 wherein the step of analyzing comprises:

a) analyzing the image projected from the surface across the full width of the cross process direction of the surface using the arithmetic logic unit.

* * * * *